US007898481B2

(12) United States Patent
Qian et al.

(10) Patent No.: US 7,898,481 B2
(45) Date of Patent: Mar. 1, 2011

(54) RADIO FREQUENCY SYSTEM COMPONENT WITH CONFIGURABLE ANISOTROPIC ELEMENT

(75) Inventors: Zhengfang Qian, Rolling Meadows, IL (US); Rudy M. Emrick, Gilbert, AZ (US); Zili Li, Barrington, IL (US); Roger L. Scheer, Beach Park, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 620 days.

(21) Appl. No.: 11/970,813

(22) Filed: Jan. 8, 2008

(65) Prior Publication Data

US 2009/0174606 A1 Jul. 9, 2009

(51) Int. Cl.
*H01Q 1/38* (2006.01)

(52) U.S. Cl. ..... 343/700 MS

(58) Field of Classification Search ..... 343/700 MS, 343/702, 789, 872, 873
See application file for complete search history.

(56) References Cited

U.S. PATENT DOCUMENTS

| | | | | |
|---|---|---|---|---|
| 4,656,483 | A * | 4/1987 | Jaquet | 343/745 |
| 5,771,027 | A * | 6/1998 | Marks et al. | 343/912 |
| 6,501,427 | B1 | 12/2002 | Lilly et al. | |
| 6,697,248 | B1 * | 2/2004 | Luch | 361/220 |
| 6,870,516 | B2 | 3/2005 | Aisenbrey | |
| 7,050,011 | B2 * | 5/2006 | Ghabra et al. | 343/711 |
| 7,623,071 | B2 * | 11/2009 | Ginn et al. | 343/700 MS |
| 2006/0092370 | A1 | 5/2006 | Lu | |
| 2006/0158622 | A1 | 7/2006 | Bhowmik | |

FOREIGN PATENT DOCUMENTS

| | | | |
|---|---|---|---|
| JP | 2005-109870 | * | 4/2005 |
| JP | 2005-109870 | A | 4/2005 |
| JP | 2006-131903 | A | 5/2006 |
| KR | 10-2004-0048848 | A | 6/2004 |

OTHER PUBLICATIONS

Akira Onuki, "Liquid Crystals in Electric Field," Journal of the Physical Society of Japan, vol. 73, No. 3, Mar. 2004, pp. 511-514.
Lapointe, et al., "Elastic Torque and the Levitation of Metal Wires by a Nematic Liquid Crystal," Science Magazine, vol. 303, Jan. 30, 2004, pp. 652-655.
Dierking, et al., "Magnetically Steered Liquid Crystal-Nanotube Switch," American Institue of Physics, Dec. 2, 2005, Applied Physics Letters 87, 233507 (2005) 3 pages.
Yun Kwon Nam, "PCT International Search Report and Written Opinion," WIPO, ISA/KR, Korean Intellectual Property Office, Daejeon, Republic of Korea, Mar. 31, 2009.

* cited by examiner

*Primary Examiner* — Huedung Mancuso

(57) ABSTRACT

Antennas (100, 1000, 1600, 1800, 1900) or other radio frequency components that include an electrically configurable anisotropic element (112, 1502, 1608, 1806) are provided. According to certain embodiments the electrical configurable anisotropic element (112, 1502, 1608, 1806, 1904, 1906, 1918, 1920, 1922) includes a material (202, 1912, 1924) including carbon nanotubes or conductive nano-tubes or nano-wires (208) dispersed in a liquid crystal material or other medium with that can be aligned by an applied field.

15 Claims, 6 Drawing Sheets

FIG. 1
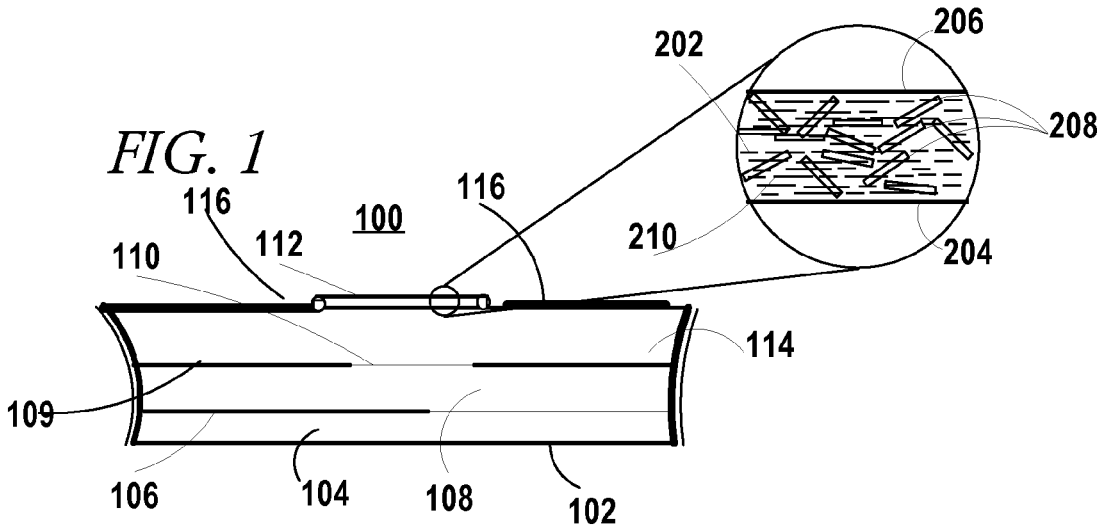
FIG. 2
FIG. 3
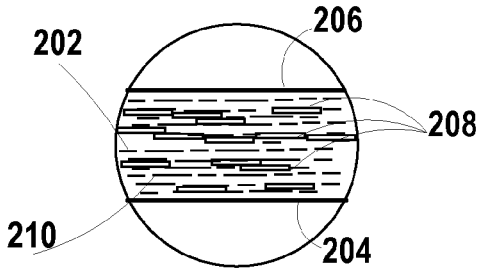
FIG. 4
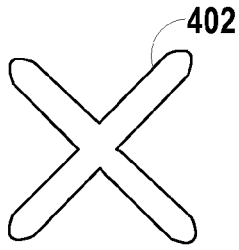
FIG. 5
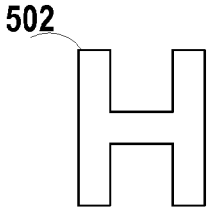
FIG. 6
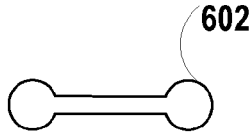

RADIO FREQUENCY SYSTEM COMPONENT WITH CONFIGURABLE ANISOTROPIC ELEMENT

FIELD OF THE INVENTION

The present invention relates generally to radio frequency system components.

BACKGROUND

Radio frequency technology is used in a variety of applications, two broad categories of which are sensing and communication. The former category includes such diverse applications as Magnetic Resonance Imaging (MRI) and Radio Detection and Ranging (Radar). The latter category includes wireless communication using a myriad of different frequency bands and protocols including cellular telephony. Cellular telephony has revolutionized communication and continues to grow in importance. For cellular telephony in particular distinct frequency bands are often used in the same geographic area because there are competing standards and in order to support legacy devices. Moreover, more frequency bands are being allocated for higher bandwidth services that are being introduced. A particular wireless device may support more than one protocol for more than one application. Examples of protocols are, RFID, WLAN, WiMAX, UWB, 3G and 4G. Examples of applications are multimedia, mobile internet, connected home solutions, and sensor-networks. In this situation it is desirable to provide increasing physical channel diversity (e.g., frequencies, polarizations) in a single wireless communication device. Diversity can also be a means to improved Quality of Service (QoS) in challenging Radio Frequency (RF) environments (e.g., urban settings). Moreover, reconfigurable, multimode antennas are needed to be able to adapt to multiple user positions, restrictive data mode grips, and other environmental variables. As a result, there is a strong demand for antennas that are resonant at multiple frequencies or can be tuned to multiple frequencies and/or different polarizations and that have thin and flexible form factors. Consumer expectations call for small wireless handsets (e.g., cellular telephones, smart phones, etc.), which have limited space for their antenna systems. Thus, there is a strong need for antenna systems that provide more frequency bands and agile polarization diversity without requiring much more space.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 1 is a fragmentary sectional elevation view a planar antenna according to an embodiment of the invention;

FIGS. 2-3 are cross sectional views of a cell including an electrically configurable anisotropic medium that is used in the antenna shown in FIG. 1 according to an embodiment of the invention;

FIG. 4 is a plan view of a cross-shaped slot used in the antenna shown in FIG. 1 according to an embodiment of the invention;

FIG. 5 is a plan view of an H-shaped slot used in the antenna shown in FIG. 1 according to an alternative embodiment of the invention;

FIG. 6 is a plan view of "dog bone" shaped slot used in the antenna shown in FIG. 1 according to yet another alternative embodiment of the invention;

Figure 7:
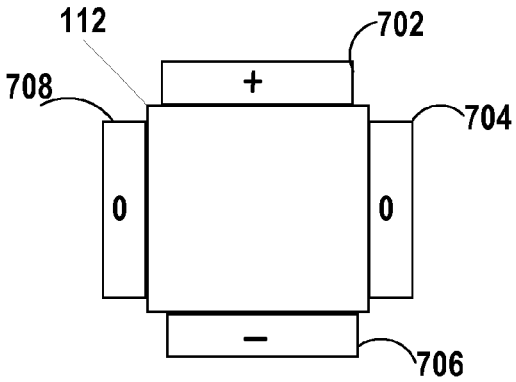
FIG. 7 shows a plan view of the cell shown in FIGS. 2-3 along with an arrangement of control electrodes in a first state according to an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to radio frequency technology. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Nanostructures such as nanotubes and nano-wires show promise for the development of radiation elements of antennas. Preparation of these nanostructures by chemical vapor deposition (CVD) has shown a clear advantage over other approaches. The CVD approach allows for the growth of high quality nanotubes by controlling their length, diameter, location, and pattern using catalytic nano-particles. In particular, carbon nanotubes are typically a helical tubular structure grown with a single wall or multi-wall, and commonly referred to as single-walled nanotubes (SWNTs), or multi-walled nanotubes (MWNTs), respectively. Single wall carbon nanotubes typically have a diameter in the range from a fraction of a nanometer to a few nanometers. Multiwall carbon nanotubes typically have an outer diameter in the range from a few nanometers to several hundreds of nanometers, depending on inner diameters and numbers of layers. Each layer of a MWNT is a single wall tube. Carbon nanotubes can function as either a conductor, like metal, or a semiconductor, according to the rolled shape (chirality) and the diameter of the helical tubes. With metallic nanotubes, a carbon-based structure can conduct a current in one direction at room temperature with essentially ballistic conductance so that metallic nanotubes can be used as ideal radiation elements.

Liquid crystals (LCs) with several basic phases are widely used for various display devices. Recent publications have shown that a liquid crystal, for instance, nematic phase, can be utilized to host carbon nanotubes (CNTs) and effectively disperse the CNTs in the LC host matrix. CNTs are thus uniformly distributed in a LC host matrix. The LC host is made up of elongated molecules and has anisotropic dielectric properties. The so-called Freedericksz transition is a fundamental aspect of liquid crystals. In the transition a collective reorientation of the LC director along the direction of an applied electric field for, e.g., positive dielectric anisotropy and the molecules align with each other in a process of self-organization. It has been shown that the LC order can be transferred to carbon nanotubes dispersed in the LC by elastic interactions. Therefore, well-aligned nanotubes with their tube axes aligned in the direction of the LC director can be formed and controlled by an applied electric or magnetic field. Very large increases of electrical conductivity (e.g., several orders of magnitude) have been observed. The increases are theorized to be due to the formation of multiple conducting paths through tube-to-tube conducting and super conductivity of metallic CNTs. Moreover, small quantities of conductive ions existing in a LC host have been shown to be trapped by the CNTs in tube-to-tube conducting areas through charging. Dipole moments due to ion trapping by CNTs can serve to further enhance long-range elastic interactions for the realignment of the CNTs under an applied electric or magnetic field. Combining the low loss, high anisotropic conductivity of metallic CNTs and the proper utilization of electric or magnetic field for alignment control and switching, and the choice of various LC phases, the LC-CNT media can be uniquely used for antenna designs with agile polarization diversity and multi-bands in a limited design space. The aforementioned properties are exploited in the present innovation.

FIG. 1 is a fragmentary sectional elevation view a planar patch antenna 100 according to an embodiment of the invention. The planar patch antenna 100 comprises a number of patterned conductor layers separated by dielectric layers as will be described. A DC grounding layer 102 is located on the bottom of the planar antenna 100. The DC grounding layer 102 is spaced by a first dielectric layer 104 from a stripline feed 106. The stripline feed 106 is connected to a transceiver (not shown) which receives and/or transmits using the planar patch antenna 100. The stripline feed 106 is spaced by a second dielectric layer 108 from a slot 110 which is formed in an antenna ground plane 109. Various possible alternative slot shapes with different excitation methods and bandwidth enhancement are shown in FIGS. 4-6. FIG. 4 shows a crossed slot 402, FIG. 5 shows an H-slot 502, FIG. 6 shows a "dog bone" slot 602. The stripline feed 106 is an active element of the antenna 100. A cell 112 holding an electrically configurable anisotropic material 202 is located above the slot 110 and spaced from the slot 110 by a third dielectric layer 114. Several electrodes 116 are positioned around the cell 112 and make electric contact with the cell 112 on their edge surfaces. The cell 112 holding the electrically configurable anisotropy material in combination with the electrodes 116 act as a parasitic (passive) radiating element of the antenna 100. The specifically-shaped slots shown in FIGS. 4-6 are able to excite the passive radiating element in different ways via electromagnetic coupling. As shown in FIG. 2 the cell 112 includes the anisotropic material 202 enclosed between a lower dielectric film 204 and an upper dielectric film 206 that can be called a superstrate. The lower dielectric film 204 is not necessary if a cavity for the cell 112 is formed on the surface of the third dielectric layer 114. According to embodiments of the invention the electrically configurable anisotropic material 202 includes elongated conductive bodies 208 dispersed in a medium 210. According to certain embodiments the elongated bodies 208 are Carbon Nanotubes (CNT) and the medium 208 is a Liquid Crystal (LC). The latter combination is referred to herein below by the abbreviation LC-CNT. According to certain embodiments the CNTs are Multi-Walled Carbon Nanotubes (MWCNTs). Metallic single-walled carbon nanotubes (SWCNTS) can also be used as the CNTs. Other types of metallic nano-wires can also be used as the elongated bodies. Pre-alignment of the LC-CNT can be achieved by mechanical means such as rubbing technique on the inner surfaces of dielectric films 204 and 206. However, pre-alignment is not required.

FIG. 2 shows a random arrangement of the elongated bodies 208 that prevails when no voltage is applied to the electrodes 116. On the other hand FIG. 3 shows a parallel alignment and tube-tube conducting paths of the elongated bodies that are established when an electric field is applied to two or more of the electrodes 116.

The overall size of the cell 112 and electrodes 116 depends on the frequency (wavelength) of the antenna 100 which may be varied for different applications. The cell size 112 can range from nanometers for optical antennas, sub-micron for terahertz, to micron for sub-millimeter wave, and to millimeter for millimeter wave and microwave antennas. The volume fraction of the elongated bodies 208 such as CNTs needs to be sufficiently high so that multiple conducting paths can be established after the LC-CNT alignment. Started from a certain percentage, e.g., the so-called percolation percentage where at least a conducting path is established, the CNT volume fraction can be ranged from 0.01 percent to 50 percent and even higher if needed. The volume fraction depends on the choice of the average CNT length ranging from nanometers to micrometers and millimeters, the CNT length distribution and aspect ratio (length to diameter) distribution. Millimeter long CNTs can be used in larger sized cells 112 for microwave antennas. Moreover, the LC-CNT media 202 can be doped with the small amount of conducting ions. In some cases, the ions are present as impurities. Furthermore, strong charge transfer from the adjacent LC molecules to CNTs and consequently ion trapping by the CNTs can be used for enhancing electric conductivity and alignment by creating CNT's with a long-range permanent dipole moment. Ions trapped between CNTs after alignment by electrical and/or mechanical means can significantly increase the CNT tube-to-tube conductivity. Different kinds of liquid crystals (LCs) can be selected as the media 210. Nematic, cholesteric, semectic phases and their mixtures can be chosen although the nematic LC is preferred.

Figure 8:
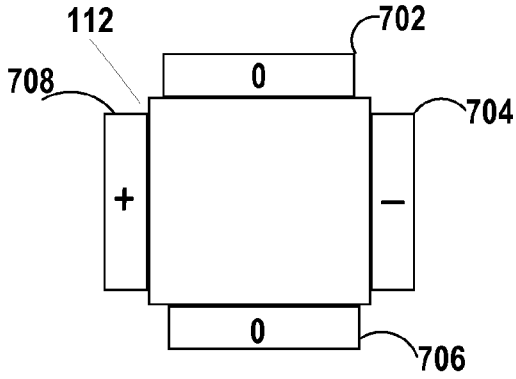
FIG. 8-9 show alternative states of the electrodes and cell shown in FIG. 7.
Figure 9:
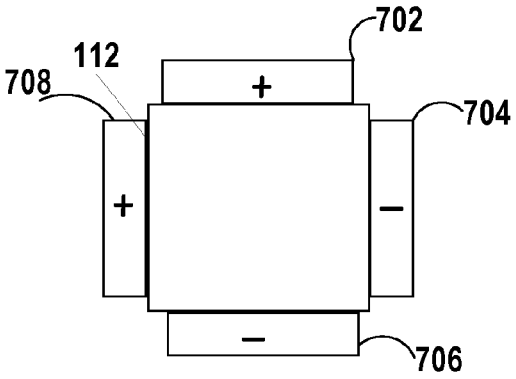

FIGS. 7-9 are plan views of the planar antenna 100 showing the cell 112 and the electrodes 116. In FIGS. 7-9 the electrodes 116 are identified by unique reference numerals. As shown in FIGS. 7-9 the electrodes 116 include an upper electrode 702, a right electrode 704, a bottom electrode 706 and a left electrode 708. The electrodes 702-708 are used to apply different electric fields to the material 202 in order to change the electric current directionality and pattern of the anisotropy of the material 202. As shown in FIG. 7 a positive potential is applied to the upper electrode 702 and a negative potential is applied to the lower electrode 706 while the right electrode 704 and left electrode 708 are grounded. With the potential as shown in FIG. 7, in a first case that the LC exhibits positive dielectric anisotropy the directors of the LC will align vertically parallel to the electric field extending from the upper electrode 702 to the lower electrode 706, leading to a radiated field having a first polarization state. Alternatively, if the LC has a negative dielectric anisotropy the LC directors will align perpendicular to the electric field. Moreover, charge transfer from LC molecule to CNT and the ion trapping by CNTs result in permanent dipole moments. The long-range moments strongly assist alignment under the applied electric field. In either case the alignment results in the formation of tube-to-tube electric contacts for creating multiple long-range conducting paths crossing the cell 112 length scale and reaching to electrodes 116. Therefore, an anisotropic polarization is formed by the anisotropic polarization media. The polarization pattern or the distribution of electrical current directions can be controlled by an applied electric (or alternatively magnetic) field.

In FIG. 8 positive and negative potentials are applied to the right electrode 704 and the left electrode 708 respectively while the upper electrode 702 and the lower electrode 706 are grounded. With the potentials applied as shown in FIG. 8, if the LC exhibits a positive anisotropy a second polarization state of the radiated field that is different from the first polarization state will be produced. As shown in FIG. 9 the positive potential is applied to the upper electrode 702 and the left electrode 708 and negative potential is applied to the right electrode 704 and the lower electrode 706. Each different set of electrode potentials will lead to a different electric field, a different pattern of the alignment of the directors of the LC and CNTs, and therefore, a different polarization pattern by controlled distributions of electrical currents' directions in the radiation element. Because the CNTs exhibit anisotropic conductivity and are properly dispersed inside the dielectric LC media, aligning the CNTs in different patterns will alter the radiation pattern of the planar antenna 100. By using flexible materials for the dielectric layers 104, 108, and 114, the antenna structure 100 with the cell 112 and electrodes 116 can also be made conformal so that the antenna can be mounted on a curved surface such as a device housing. The antenna 100 could also be molded onto a housing of a wireless device by different molding techniques such as insert, injection, and two-shot moldings.

According to certain embodiments of the invention the slot 110 is shaped and oriented relative to the stripline feed 106, so that the stripline feed will excite an elliptical (e.g., circularly) polarized mode. Alternatively, the slot 110 is shaped and oriented to produce a linearly polarized mode that is aligned at an angle (e.g., 45 degrees) relative to the cardinal alignment (e.g., up, down, left, right) of the electrodes 702-708. In either case, by altering the pattern of alignment of the CNTs in the cell 112 the radiation pattern of the planar antenna 100 will be altered. In particular, the polarization of waves emitted by the antenna 100 can be varied and tuned by the antenna designs with different combinations of anisotropic polarization elements composed of cell 112 and electrode 116 from FIG. 7-9 with slot shapes of 110 from FIG. 4-6. Thus, the antenna 100 is capable of increasing the physical channel diversity and frequency agility.

Figure 10:
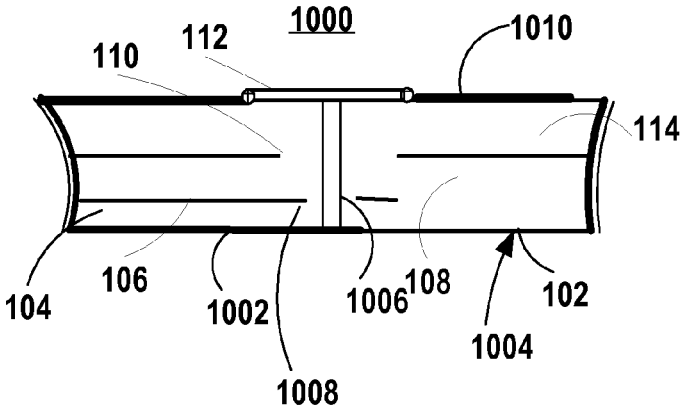
FIG. 10 is a fragmentary sectional elevation view of a planar antenna according to an alternative embodiment of the invention.
Figure 11:
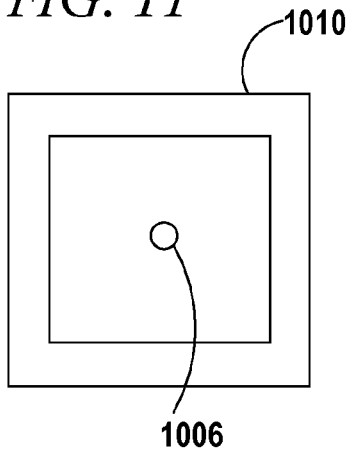
FIG. 11 shows a plan view of a cell including an electrically configurable electromagnetically anisotropic medium along with an arrangement of control electrodes used in the planar antenna shown in FIG. 10.
Figure 12:
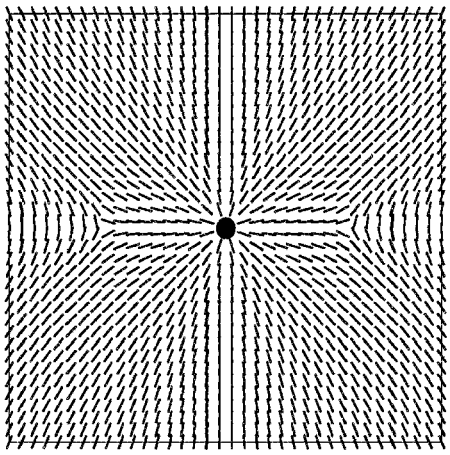
FIG. 12 shows an approximate pattern of alignment of elongated conductors when suspended in a liquid crystal having a positive anisotropy and subjected to an electric field established in the cell.
Figure 13:
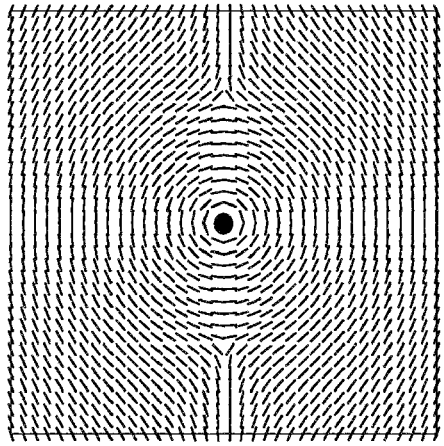
FIG. 13 is similar to FIG. 12 but with a liquid crystal having a negative anisotropy.

FIG. 10 is a fragmentary sectional elevation view of a second planar antenna 1000 according to an alternative embodiment of the invention. The second planar antenna 1000 differs from the planar antenna 100 shown in FIG. 1 in that the second planar antenna 1000 includes conductive trace 1002 that extends along a bottom surface 1004 of the first dielectric layer 104 to a conductive via 1006 that extends through the first dielectric layer 104, through an aperture 1008 in the stripline feed 106, through the second dielectric layer 108, through the slot 110 and the third dielectric layer 114 to the cell 112. For microwave frequencies the via can have a diameter of several microns. For sub-millimeter, terahertz or optical communications a smaller diameter via may be appropriate. In the latter case, a single MWCNT or the bundle of MWCNTs or SWCNTs can be used for constructing the via 1006 by proper metallization of the end of the CNTs and connection with the conductive trace 1002. The conductive via 1006 works in conjunction with a peripheral electrode 1010 that surrounds the cell 112, allowing radial electric fields to be established for the purpose of aligning an electrically configurable anisotropic material (e.g., LC-CNT) in the cell 112. FIG. 11 shows a plan view of the cell 112 with the peripheral electrode 1010 and the top of the conductive via 1006. FIG. 12 shows an approximate two-dimensional pattern of alignment of elongated conductors when suspended in a liquid crystal having a positive dielectric anisotropy and subjected to an electric field established in the cell 112 as shown in FIG. 11. FIG. 13 is similar to FIG. 12 but with a liquid crystal having a negative dielectric anisotropy. Different patterns of electric current distributions can be established by aligning CNTs in LC having different anisotropy properties. By combining one of the slot shapes shown in FIGS. 4-6 with an electric current distribution pattern supported by the LC-CNT patterns shown in FIG. 12-13, multiple resonant frequencies and an agile polarization pattern can be obtained in a single patch antenna construction, thereby achieving increased physical channel diversity.

Figure 14:
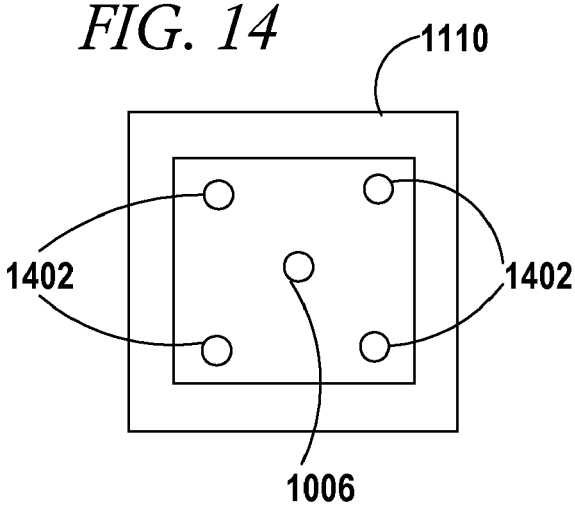
FIG. 14 shows a plan views of a cell holding an electrically configurable electromagnetically anisotropic media along with an arrangement of an outer control electrode and via pins according to another alternative embodiment of the invention.
Figure 15:
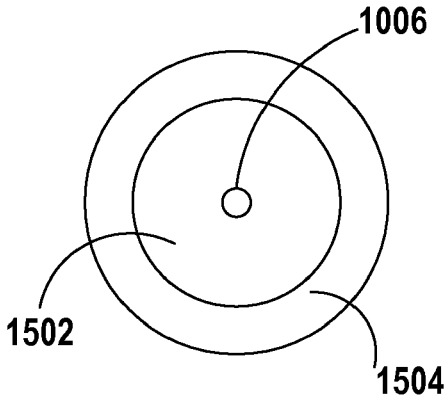
FIG. 15 is similar to FIG. 11 but with an alternative outer electrode shape.

FIGS. 14-15 show plan views of cells holding electrically configurable electromagnetically anisotropic media along with arrangements of control electrodes according to other alternative embodiments of the invention. In FIG. 14 in addition to the single central conductive via 1006 there are four additional conductive vias 1402 arranged in a specific pattern. Locations of the vias 1402 are dependent on the shape of the slot 110 and can be determined by routine experiment. The via location can be tuned to match desired frequency bands. Via numbers can be increased or decreased as needed to achieve specific frequency bands and/or polarization patterns. Vias can also be switched on simultaneously or sequentially for applying different electric fields for CNT alignment and pattern formation. This capability further increases the antenna design robustness and tunability for both frequency and polarization patterns. Alternatively, the vias 1402 can also be used as shorting pins by connecting them with the antenna grounding plane while the central via 1006 is used for applying a voltage to establish a field for CNT alignment. Similar to via 1006, the additional vias 1402 can be constructed by using a single MWCNT or CNT bundles.

In FIG. 15 a round cell 1502 is used instead of the square cell 112 with a round peripheral electrode 1504. In the round cell 1502, radial or circumferential (azimuthal) conductivity can be obtained by using a LC host that exhibits positive or negative dielectric anisotropy respectively after an electrical (or magnetic) field is applied for CNT alignment. In combination with the feeding slots (FIGS. 4-6), the round cell can also create different frequency bands with polarization agility.

After aligning the CNTs' with an applied electric (or magnetic) field adjusting the LC-CNT alignment pattern in order to achieve operation in predetermined frequency bands with predetermined polarization patterns for particular RF applications, the LC-CNT mixture material 202 inside the cell 112 can be polymerized. In this way, well-dispersed CNTs with multiple conducting paths and electrical polarization patterns are locked-in and embedded inside a liquid crystal polymer matrix. In this case of off-line alignment and tuning, high voltage can be applied to generate a very strong field for better CNT alignment and tube-to-tube conducting. The field can be removed after the pattern is locked-in by polymerization.

Figure 16:
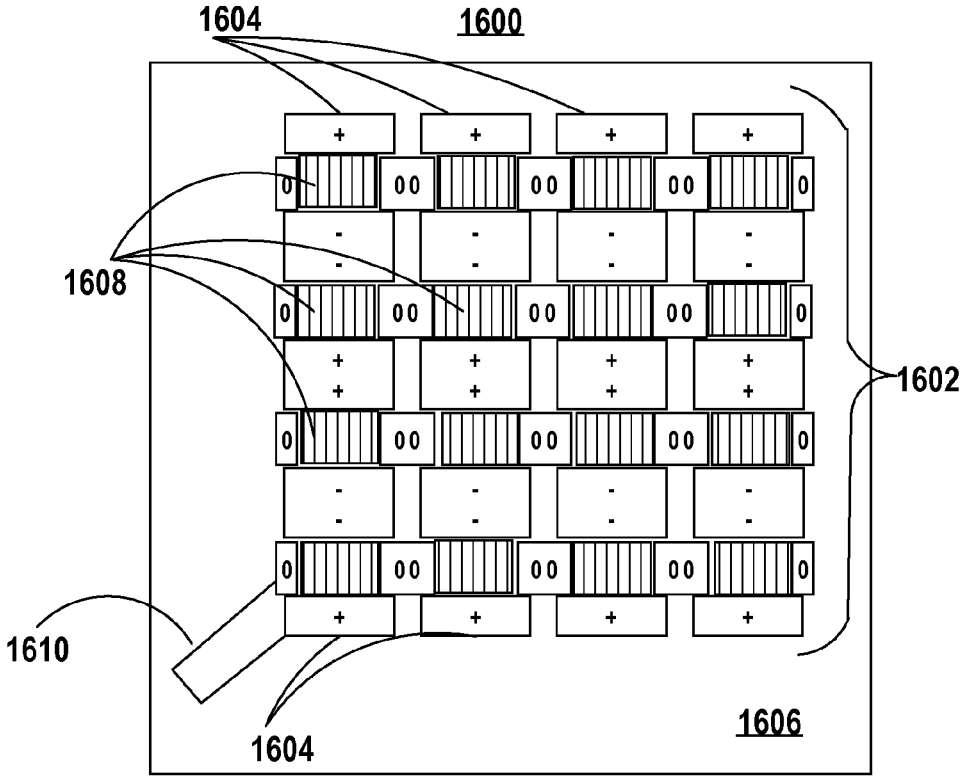
FIGS. 16-17 are plan views of a planar antenna that has a 2-D array of drive electrodes and cells holding an electrically configurable electromagnetically anisotropic media.
Figure 17:
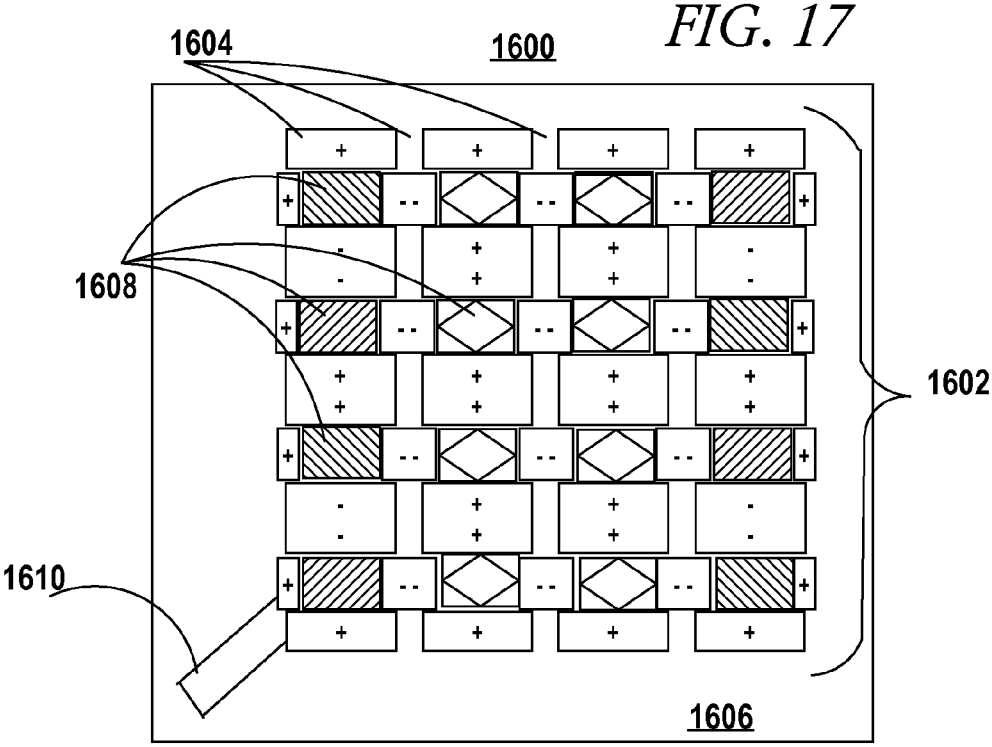

FIGS. 16-17 show a planar antenna 1600 according to another embodiment of the invention. The planar antenna 1600 has a rectangular array 1602 of rectangular electrodes 1604 (only a few of which are indicated by reference numeral to avoid crowding the drawing), supported on a dielectric substrate 1606. (Alternatively the shape of the array 1602 and/or the shapes of the electrodes 1604 may be other than rectangular, for example, oval or circular.) An array of cells 1608 (only a few of which are indicated by reference numeral) holding the configurable anisotropic material 202 including the elongated bodies 208 dispersed in a medium 210 (e.g., the LC-CNT material) are located in interstices between the electrodes 1604. Thus, the electrodes 1604 are positioned around the cells 1608 and by applying different combinations of voltages to the electrodes 1604, different electric field patterns can be established in the cells 1608 in order to configure the configurable anisotropic material 202. In FIGS. 16-17 '+' and '−' signs and zero marked on the electrodes 1604 indicated applied voltages. Additionally, the alignment of the elongated bodies (e.g., CNT) is indicated by cross hatching and diamond shapes in the cells 1608.

More patterns than are represented in FIGS. 16-17 can be produced by applying different combinations of voltages to the electrodes 1604. The sizes of the cells 1608 and electrodes 1604 is scaleable to accommodate operation at different frequencies ranging from microwave frequencies to millimeter, and sub-millimeter wave frequencies. For higher frequency bands up to Terahertz and beyond, the cells 1608 and electrodes 1604 can be fabricated at micro and nano scales if needed. At such scales shorter CNTs with nanometer lengths can be used. Even if the voltage that can be applied to the electrodes 1604 in order to align the LC-CNT material is limited, the cell 1608 size can be reduced and numbers of the cells can be increased in order to achieve high electric field stength. Therefore, the robustness of the design shown in FIGS. 16-17 with the scalable capability provides device solutions for antennas for a wide range of frequency bands. The slots 402, 502, 602 shown in FIGS. 4-6 can be used to drive the planar antenna 1600 which would be arranged overlying but spaced from the slots 402, 502, 602. Alternatively, an in-plane antenna feed 1610 can be coupled directly (e.g., at a corner) to the antenna 1600. Alternatively, the antenna 1600 can be made into a phased array antenna by spacing the cells 1608 by about one-half the operating wavelength. Such a phased array antenna will be active with the capability of polarization diversity.

Figure 18:
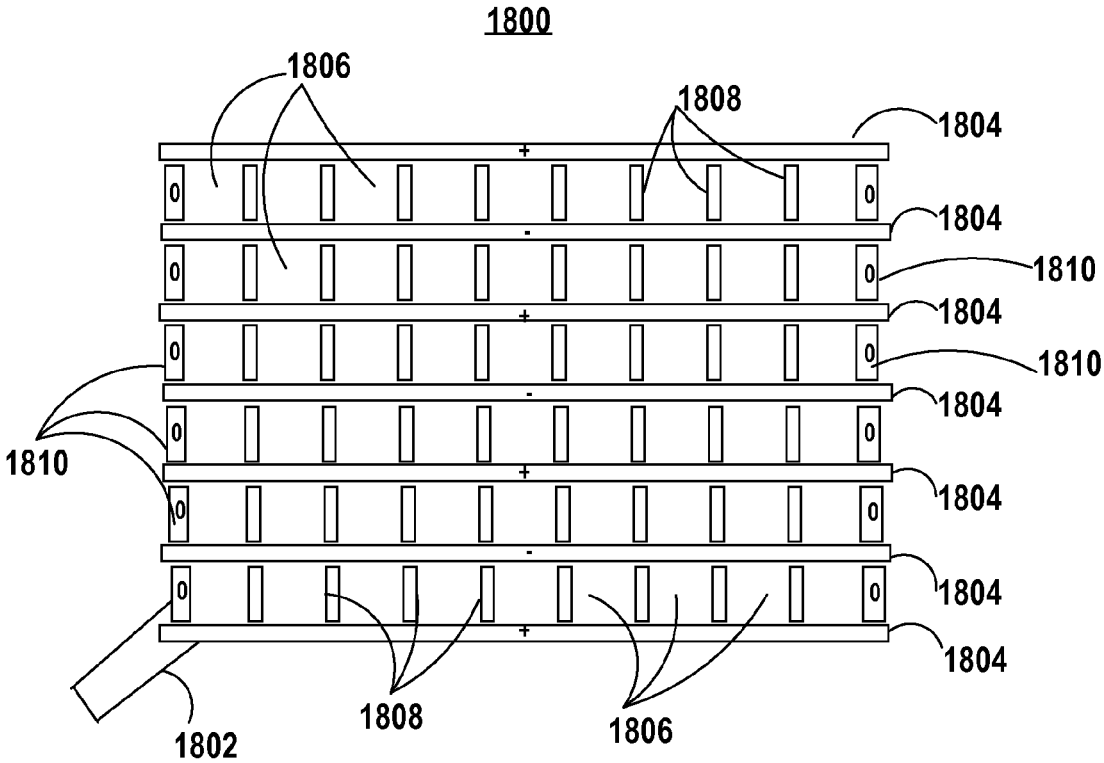
FIG. 18 is a plan view of a planar antenna element that has a plurality of linear drive electrodes alternating in position with cells holding an electrically configurable electromagnetically anisotropic media.

FIG. 18 is a plan view of a planar antenna element 1800 that has a plurality of linear drive electrodes alternating in position with cells holding an electrically configurable electromagnetically anisotropic media. The antenna element 1800 can be located over a slot antenna such as shown in FIGS. 4-6 and function as a radiation modifier, or can be fed microwave energy directly using a stripline 1802 and act as an active antenna element. The planar antenna element 1800 has a set of elongated horizontally extending (in the perspective of FIG. 18) electrodes 1804 that are spaced apart from each other. Located between the horizontally extending electrodes 1804 are a plurality of cells 1806 that hold the aforementioned LC-CNT material. A plurality of vertical spacer bars 1808 extend between each pair of adjacent horizontally extending electrodes 1804. At the left and right sides of the antenna element 1800 there are vertically extending electrodes 1810 located between the horizontal electrodes 1804.

In the configuration shown in FIG. 18 successive horizontal electrodes in the set 1804 alternate between positive and a negative applied voltages, and the vertically extending electrodes 1810 have zero voltage. With the foregoing set of voltages, assuming a positive anisotropy of the LC, the LC-CNT material will be vertically polarized effectively providing microwave conductance in the vertical direction. Conductance in the horizontal direction will be provided by the horizontally extending electrodes 1804. In the case that the antenna element 1800 is directly driven using the stripline 1802, the antenna element 1800 will be able to radiate two orthogonal polarization components. When the voltages on the horizontally extending electrodes 1804 is removed, the vertical conductance of the LC-CNT will diminish and the vertical polarization radiation component will diminish. This capability provides a de-tuning solution.

In the case that the antenna element 1800 is used over a slot antenna, varying the voltages on the horizontally extending electrodes 1804 will vary the relative magnitude of the two orthogonal polarization components.

Figure 19:
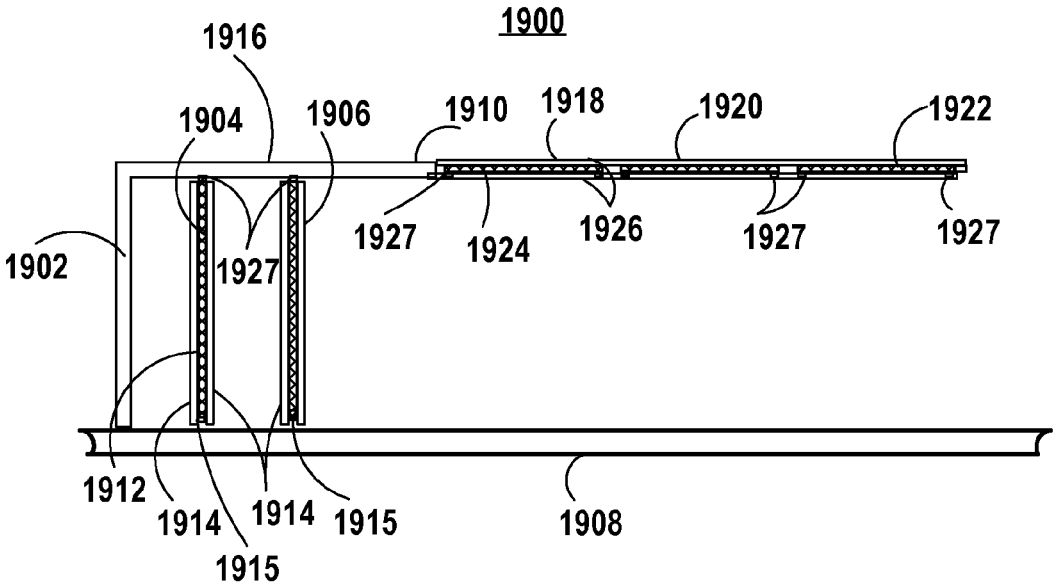
FIG. 19 is a planar inverted "F" antenna that includes multiple tuning cells for frequency tuning.

FIG. 19 is a planar inverted "F" antenna 1900 that includes multiple tuning cells for frequency tuning. The antenna 1900 has a ground leg 1902, a first feed leg 1904 and a second feed leg 1906, a common ground plane 1908, and a main radiating element 1910 that is arranged parallel to and spaced from the ground plane 1908. The ground leg 1902 extends from the ground plane 1902 to the main radiating element 1910. The feed legs extend from a location proximate the ground plane 1902 to the main radiating element 1910.

The feed legs 1904, 1906 include the LC-CNT 1912 (or other configurable anisotropic medium) held between two dielectric substrates 1914. A microwave signal can be coupled through either of the feed legs 1904, 1906. One of the feed legs 1904 1906 is selectively activated by a DC biasing signal through the electrodes 1915, 1927 in order to apply a DC field to the LC-CNT 1912. End electrodes 1915 are provided for coupling the microwave signal to the LC-CNT 1912 and applying the DC biasing signal to the LC-CNT. The DC biasing signal sets up a longitudinal electric field that orients the LC-CNT material 1912 to switch on the feed legs 1904 and 1906. Selecting between the feed legs 1904, 1906 enables the antenna 1900 to be tuned to different frequency ranges as needed.

The main radiating element 1910 comprises conducting portion 1916 to which the ground leg 1902 and the feed legs 1904, 1906 attach, as well as a first extension 1918, a second extension 1920 and a third extension 1922 which are connected in series to the conducting portion 1916. The conducting portion 1916 is an active element of the antenna. With reference to the first extension 1918 in FIG. 19, each extension includes a layer of LC-CNT material 1924 held between two dielectric strips or substrates 1926. Electrodes 1927 located at ends of the extensions 1918, 1920, 1922 and the feed legs 1904, 1906 are used to apply DC biasing fields to the LC-CNT 1924, 1912. There is a gap between the electrodes 1927 of the different extensions 1918,1920,1922, and between the first extension 1918 and the conducting portion 1916 which isolates DC bias current but passes microwave currents by capacitive coupling. The gap can be filled with air or other dielectric materials. Different combinations of the extensions 1918, 1920, 1922 can be activated by applying DC biasing signals in order to establish longitudinal electric fields in the extensions 1918, 1920, 1922. Actuating different combinations of activated extensions 1918, 1920, 1920 will cause the antenna 1900 to operate at different frequencies by changing its physical length, the impedance, and/or by parasitic tuning elements. In the case that there is an active extension (e.g., 1920, 1922) separated from the conducting portion 1916 of the main radiating element 1910 by an inactive extension (e.g., 1918), the active extension will act as a parasitic antenna element. Thus, frequency diversity is achieved by activating different combinations of the feed legs 1904, 1906 and the extensions 1918, 1920, 1922. Although three extensions 1918, 1920, 1922 are show, alternatively more or less than three extensions can be provided. Alternatively the antenna 1900 is a non-planar (wire) inverted F antenna.

Figure 20:
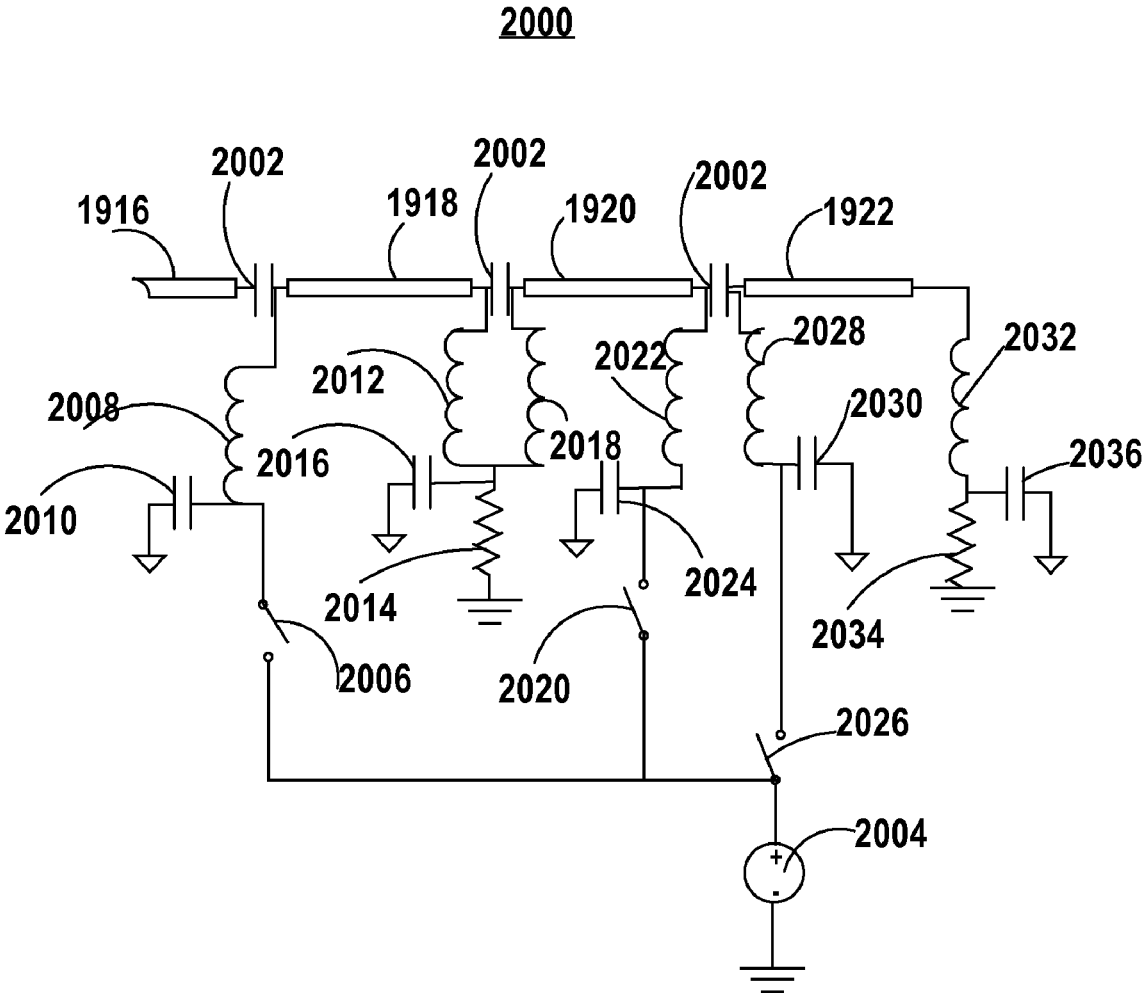
FIG. 20 is schematic of a biasing circuit for the antenna shown in FIG. 19.

FIG. 20 is schematic of a biasing circuit 2000 for the antenna shown in FIG. 19. The circuit 2000 is for biasing the extensions 1918, 1920, 1922. A similar circuit can be used for biasing the feed legs 1904, 1906. Referring to FIG. 20 a series of capacitances 2002 provide DC isolation between the conducting portion 1916 and the first extension 1918 and between successive extensions 1918, 1920, 1922. The capacitances 2002 may be realized by discrete capacitors or a gap filled with air or other dielectric materials. Microwave signals can pass through the capacitances 2002.

A biasing DC voltage source 2004 is selectively applied through the circuit in order to establish a longitudinal biasing E-field in one or more of the extensions 1918, 1920, 1922. The biasing voltage source 2004 may be variable. The biasing source 2004 is connected to the left side of the first extension 1918 through a first switch 2006 and a first inductor 2008. A first capacitor 2010 is connected between the junction of the first switch 2006 and the first inductor 2008 and an RF ground. The first inductor 2008 and the first capacitor 2010 as well as other similar arrangements of capacitors and inductors described below serve to isolate the biasing voltage source 2004 from microwave currents flowing in the antenna 1900.

The right side of the first extension 1918 is connected to a second inductor 2012 which is connected to a first resistor 2014 and a second capacitor 2016. The first resistor 2014 is connected to a biasing signal ground and the second capacitor 2016 is connected to the RF ground. The left side of the second extension 1920 is connected through a third inductor 2018 to the first resistor 2014 and the second capacitor 2016.

The biasing voltage source 2004 is connected through a second switch 2020 and a fourth inductor 2022 to the right side of the second extension 1920. A third capacitor 2024 is connected between the junction of the fourth inductor 2022 and the second switch 2020 and the RF ground.

Similarly, the biasing voltage source 2004 is connected through a third switch 2026 and a fifth inductor 2028 to the left side of the third extension 1922, and a fourth capacitor 2030 is connected between the junction of the fifth inductor 2028 and the third switch 2026 and the RF ground.

Additionally, the right side of the third extension 1922 is connected through a series of a sixth inductor 2032 and a second resistor 2034 to ground; and a fifth capacitor 2036 is coupled between the junction of the sixth inductor 2032 and the second resistor 2034 and the RF ground.

By selectively closing one or a combination of the switches 2006, 2020, 2026 the voltage from the biasing source 2004 can be applied to one or a combination of the extensions 1918, 1920, 1922. Components of the biasing circuit can be located both on the planar inverted "F" antenna 1900 itself and on a circuit board that includes the ground plane 1908.

The inductors 2008, 2012, 2018, 2022, 2028, 2032 are RF chokes to isolate the DC power supply from the RF signal. In addition, capacitors 2010, 2016, 2018, 2030, 2036 are RF bypass capacitors to further protect the DC circuit and are connected to a common RF ground. Switches 2006, 2020, 2026 are used to turn on or off the DC voltage source 2004. If AC grounding is to be separated from DC grounding by shielded lines or other means known in the art, a simplified circuit can be utilized for the circuit 2000. A similar circuit can also be used for biasing the feed legs 1904, 1906. and active It will be apparent to persons of ordinary skill in the art that the embodiments shown in FIG. 1-20 are merely examples of wide variety of antennas that can be variably loaded using a cell with a configurable anisotropic medium in order to achieve polarization and/or frequency agility.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. An antenna comprising:

an antenna element that comprises a medium and dispersion of elongated conductors in the medium;

a ground plane above which said main radiating element is disposed;

a ground conductor extending from said ground plane to said main radiating element; and a plurality of activatable feed conductors that comprise said medium and said dispersion of elongated conductors in said medium wherein the elongated conductors elements comprise carbon nanotubes;

wherein said element is an active element of said antenna, wherein said element is part of a main radiating element of said antenna.

2. The antenna according to claim 1 wherein said medium comprises a liquid crystal material.

3. The antenna according to claim 1 wherein said medium comprises a liquid crystal material.

4. The antenna according to claim 1 wherein said element is a passive element of said antenna.

5. The antenna according to claim 4 wherein said passive element is disposed proximate a second active element of said antenna.

6. The antenna according to claim 5 wherein said active element comprises a stripline.

7. The antenna according to claim 5 further comprising at least one electrode disposed in relation to said passive element wherein said at least one electrode is adapted to establish an electric field on said elongated conductors to orient said elongated conductors, whereby a radiation pattern of said antenna is altered.

8. The antenna according to claim 7 wherein said at least one electrode comprises at least three electrodes wherein said at least three electrodes are adapted to establish at least two distinct electric fields on said elongated conductors whereby at least two different orientation patterns of said elongated conductors are established and at least two different radiation patterns of said antenna are established.

9. The antenna according to claim 1 further comprising at least one electrode disposed in relation to said element wherein said at least one electrode is adapted to establish an electric field on said elongated conductors to orient said elongated conductors.

10. The antenna according to claim 9 wherein said at least one electrode comprises at least three electrodes wherein said at least three electrodes are adapted to establish at least two distinct electric fields on said elongated conductors whereby at least two different orientation patterns of said elongated conductors are established and at least two different radiation patterns of said antenna are established.

11. The antenna according to claim 1 comprising a plurality of cells holding said medium and a plurality of electrodes arranged around said plurality of cells.

12. The antenna according to claim 1 comprising an array of cells holding said medium and a electrodes disposed to applied fields to said array of cells.

13. An antenna comprising:

an antenna element that comprises a medium and dispersion of elongated conductors in the medium;

wherein the elongated conductors elements comprise carbon nanotubes and an array of cells holding said medium and a electrodes disposed to applied fields to said array of cells.

14. The antenna according to claim 13 wherein said array is a 2-D array.

15. An antenna comprising:

an antenna element that comprises a medium and dispersion of elongated conductors in the medium;

wherein the elongated conductors elements comprise carbon nanotubes and at least one electrode disposed in relation to said element wherein said at least one electrode is adapted to establish an electric field on said elongated conductors to orient said elongated conductors.

* * * * *